US010357102B2

(12) United States Patent
Kassanoff et al.

(10) Patent No.: US 10,357,102 B2
(45) Date of Patent: Jul. 23, 2019

(54) FURNITURE WITH ORGANIZATIONAL FRAME

(71) Applicant: Paragon Furniture, Inc., Arlington, TX (US)

(72) Inventors: Richard Kassanoff, Dallas, TX (US); Robert Larry Stewart, Grapevine, TX (US)

(73) Assignee: PARAGON FURNITURE, INC., Arlington, TX (US)

( * ) Notice: Subject to any disclaimer, the term of this patent is extended or adjusted under 35 U.S.C. 154(b) by 0 days.

(21) Appl. No.: 15/802,401

(22) Filed: Nov. 2, 2017

(65) Prior Publication Data

US 2018/0213928 A1 Aug. 2, 2018

Related U.S. Application Data

(60) Provisional application No. 62/416,663, filed on Nov. 2, 2016.

(51) Int. Cl.

| | |
|---|---|
| ***A47B 13/02*** | (2006.01) |
| ***A47B 41/00*** | (2006.01) |
| ***A47B 7/00*** | (2006.01) |
| ***A47B 97/04*** | (2006.01) |
| *A47B 13/00* | (2006.01) |

(52) U.S. Cl.

CPC ..... *A47B 13/02* (2013.01); *A47B 7/00* (2013.01); *A47B 41/00* (2013.01); *A47B 97/04* (2013.01); *A47B 2013/006* (2013.01); *A47B 2200/0019* (2013.01); *A47B 2200/0086* (2013.01)

(58) Field of Classification Search

CPC ..... A47B 13/02; A47B 7/00; A47B 41/00; A47B 97/04; A47B 2013/006; A47B 2200/0019; A47B 2200/0086

USPC ... 108/50.01, 28, 50.02, 158.12, 34, 38, 189

See application file for complete search history.

(56) References Cited

U.S. PATENT DOCUMENTS

| | | | | | |
|---|---|---|---|---|---|
| 786,526 | A * | 4/1905 | Sollom | A47B 85/06 | 108/15 |
| 2,598,128 | A * | 5/1952 | Liechty | A47B 19/08 | 108/127 |
| 2,926,794 | A * | 3/1960 | Karoff | A47B 13/16 | 108/173 |
| 3,178,198 | A * | 4/1965 | Hamilton | A47B 31/00 | 108/186 |
| 3,506,138 | A * | 4/1970 | Travis | A47B 47/03 | 108/189 |
| 5,094,352 | A * | 3/1992 | Green, Sr. | A47J 47/16 | 211/186 |
| 5,623,881 | A * | 4/1997 | Huang | A47B 21/00 | 108/102 |
| D400,361 | S * | 11/1998 | Sobrito | D6/332 | |

(Continued)

*Primary Examiner* — Jose V Chen

(74) *Attorney, Agent, or Firm* — Ferguson Braswell Fraser Kubasta PC; Kelly Kubasta; Elizabeth Philip Dahm

(57) ABSTRACT

In various implementations, furniture, such as a table (e.g., a desk) and/or free-standing board, may include an organizational frame to which other members (e.g., table top, white board, smart board, etc.) may be coupled. The frame may include legs and at least one organizational member disposed between two or more of the legs. The organizational member may include a plurality of openings. The opening(s) in the organizational member may be able to couple with one or more organization tools.

19 Claims, 12 Drawing Sheets

(56) References Cited

U.S. PATENT DOCUMENTS

| | | | | |
|---|---|---|---|---|
| 6,039,416 | A * | 3/2000 | Lambert | A47B 5/06 108/48 |
| 6,220,180 | B1 * | 4/2001 | Janowitz | A47B 21/00 108/101 |
| 6,669,214 | B1 * | 12/2003 | Dorris | B25H 3/00 280/47.19 |
| 6,722,673 | B1 * | 4/2004 | Hamlin | A47B 21/06 108/50.01 |
| 6,786,162 | B1 * | 9/2004 | Volkmer | A47B 5/06 108/115 |
| 7,325,343 | B2 * | 2/2008 | Seiber | G09F 7/18 248/451 |
| 8,539,888 | B2 * | 9/2013 | Hernandez | A47B 85/06 108/115 |
| 8,539,889 | B1 * | 9/2013 | Khalaf Allah | A47B 85/06 108/115 |
| 9,936,825 | B1 * | 4/2018 | Lindblom | A47F 5/0087 |
| 2002/0011193 | A1 * | 1/2002 | Beck | A47B 83/001 108/50.01 |
| 2004/0173125 | A1 * | 9/2004 | Chang | A47B 21/03 108/50.01 |
| 2004/0237852 | A1 * | 12/2004 | Tsai | A47B 21/03 108/92 |
| 2010/0225213 | A1 * | 9/2010 | Carter | B25H 1/02 312/258 |

* cited by examiner

FURNITURE WITH ORGANIZATIONAL FRAME

CROSS-REFERENCE TO RELATED APPLICATION

This application is claims the benefit of priority to U.S. Provisional Patent Application No. 62/416,663, entitled "Table with Organizational Frame", filed on Nov. 2, 2016, which is hereby incorporated by reference for all purposes.

TECHNICAL FIELD

The present invention relates to furniture.

BACKGROUND

Desks in school environments often include a table top and attached legs. Children and adults using the desks often use boxes, containers, and other storage options on top of the desk to store items, such as school supplies. However, table top storage can be bulky, decrease the availability of table top space and decrease collaborative learning and projects (e.g., since children may not be able to see over table top storage). Furthermore, desktop storage has a tendency to be knocked over, spill, and/or have its contents otherwise fall out creating a messy and/or unusable desktop. Some desks have a slot or cabinet that extends the length and/or depth of the table top (e.g., that is disposed under the table top to store books and other items). However, small items are quickly lost in the deep storage (e.g., due to depth of the slot, darkness in the slot, and lack of organization in the slot). Thus, there is a need for better desks and better storage.

SUMMARY

In various implementations, furniture may include an organizational frame. For example, tables (e.g., desks, computer tables, and/or printer tables), free standing boards (e.g., smart boards, white boards, chalk boards, and/or projector screens), etc. may include an organizational frame. In some implementations, a table, such as a desk, may include a table top coupled to a frame. The frame of the table may include legs and at least one organizational member disposed between the legs. The organizational member may include a plurality of coupling members, such as openings. The coupling member(s) in the organizational member may be able to couple with organization tools (e.g., pegs, hooks, brackets, containers, writing surfaces, etc.).

In various implementations, the furniture may include tables, such as desks, and freestanding furniture, such freestanding boards (e.g., smart boards, writing boards, easels, etc.).

In various implementations, a table may include one or more organizational members, a frame, and a table top (e.g., disposed on the frame and/or coupled to the frame). An organizational member may include a surface, and a plurality of organizational coupling members. Organizational coupling members may include recesses, protrusions, and/or other appropriate coupling members. Organizational coupling members may be disposed through the surface of the organizational member. Organizational coupling members may couple with one or more organizational tools or portions thereof. The frame of the table may include a first side and an opposing second side. The table may be adapted such that the second side of the frame is disposed on a surface of a location on which the table is disposed. The frame may include one or more legs. In some implementations, the frame may include at least two sets of legs that each include at least two legs. At least one of the organizational members may be disposed between two or more legs of at least one of the set of legs.

Implementations may include one or more of the following features. The table top may be disposed proximate the first surface of the frame. The table may be a desk. Leg(s) of the frame may include at least one straight section and at least one slanted section. In some implementations, each set of legs may include two legs. A leg may include a first end and an opposing second end. In some implementations, the angled section of a leg may be disposed proximate the first end of the leg, and the straight section may be disposed proximate the second end of the leg. The straight section may be disposed proximate to the angled section. In some implementations, the first ends of the legs may be closer together than the second ends of the legs in a frame and/or in a portion of the frame (e.g., a side of the frame). One or more of the legs include one or more casters.

The desk may include one of more shelves and/or drawers. Shelves and/or drawers may be disposed between at least two of the set of legs.

In various implementations, a freestanding board may include a frame, at least one organizational member, and at least one board. The frame may include at least one first leg and at least one second leg. At least one organizational member may be disposed between a first leg and a second leg of the frame. The organizational member may include a surface and a plurality of organizational coupling members disposed on the surface. Organizational coupling member(s) may couple with one or more organizational tools or portions thereof (e.g., organizational coupling members). A board may be coupled to the frame (e.g., at an end of the frame).

Implementations may include one or more of the following features. The first leg and/or the second leg may include a C-shaped member with two feet, and wherein the second leg comprises a C-shaped member with two feet. The first leg and/or the second leg may include C-shaped spine members, L-shaped spine members, and/or T-shaped spine members. The first leg may include caster(s) and/or the second leg may include caster(s). The board may include writing surface and/or a screen. The freestanding board may include a ledge. Organizational member(s) may include openings disposed through the surface of the organizational member. A first end of the board may be coupled proximate a first end of the first leg of the frame and an opposing second end of the board may be coupled to a first end of the organizational member, and wherein an opposing second end of the organizational member is coupled to the second leg of the frame.

In various implementations, a piece of furniture may include a frame and at least one organizational member. The frame may include at least one pair of legs (e.g., where a pair of legs includes a first leg and a second leg) and the frame may be adapted to couple with one or more other components of the furniture. An one organizational member may include one or more coupling members. Coupling member(s) may coupling with one or more organizational tools or portions thereof. At least one of the organizational members may be disposed between the first leg and the second leg of the frame.

Implementations may include one or more of the following features. The piece of furniture may include a table and/or a freestanding board. A first end of an organizational member may be coupled to the first leg and an opposing second end may be coupled to the second leg. A coupling member of an organizational member may include an opening, a recess, and/or a protrusion. The organizational member may include one or more apertures (e.g., to grip the furniture, to secure the furniture, and/or to facilitate moving the furniture). The furniture may include one or more organizational tools (e.g., coupleable to the organizational member). Organizational tools may include a hook, a loop, a basket, a container, and/or a bracket.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

In various implementations, furniture may include an organizational frame. Organizational frames may allow users to store tools, dispose of waste conveniently, organize components for projects, etc. For example, organizational frame(s) may allow convenient storage of building bricks, such as LEGOS®, and/or robotic components, such as VEX®, on desks. As another nonlimiting example, users may store filament spools, resins, plastics, nylons, and/or other 3D printing supplies via the organizational frame on a printing table or table proximate a printer. As another nonlimiting example, markers, stencils, teaching aids, pointers, etc. may be stored via the organizational frame of a free-standing board. As another nonlimiting example, a user may store art and/or other craft supplies such as paint, beads, brushes, canvas, paper, etc. By allowing storage of supplies that are commonly and/or occasionally used, users may spend more time on tasks (e.g., building, creating, teaching, etc.).

In various implementations, furniture may include an organizational frame. The organizational frame may be coupled to other members of the furniture, in some implementations. For example, the frame may be coupled to a table top. In some implementations, the frame may be coupled to a white board, smart board, screen, and/or other free-standing board. The organizational frame may include coupling members that allow tools, such as organizational tools to be coupled to the organizational frame. In some implementations, tools may be directly coupled to the organizational frame or portions there of (e.g., organizational member, legs, etc.).

Figure 1:
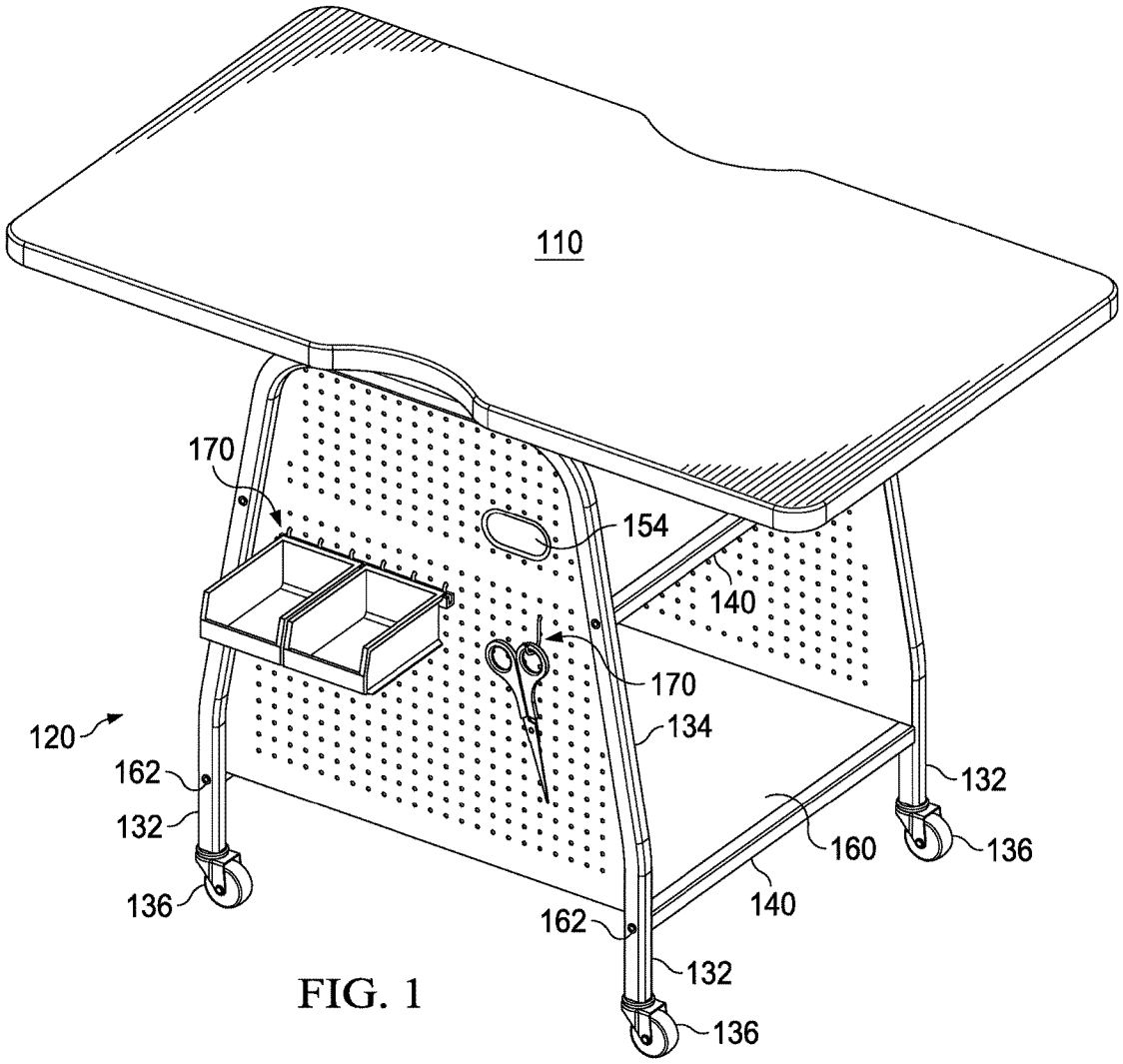
FIG. 1 illustrates a front perspective view of an implementation of an example desk.

In some implementations, the furniture may include a table, such as a desk. FIG. 1 illustrates a top perspective view of an implementation of an example desk 100. As illustrated, the desk 100 may be a desk that allows more than one person to be seated proximate the desk (e.g., more than one chair may be seated about the table top of the desk). Users may position chairs at opposing ends and/or about the table top to user the desk (e.g., to build on a surface of the desk, to use equipment disposed on the desk, to write, etc.).

Figure 2A:
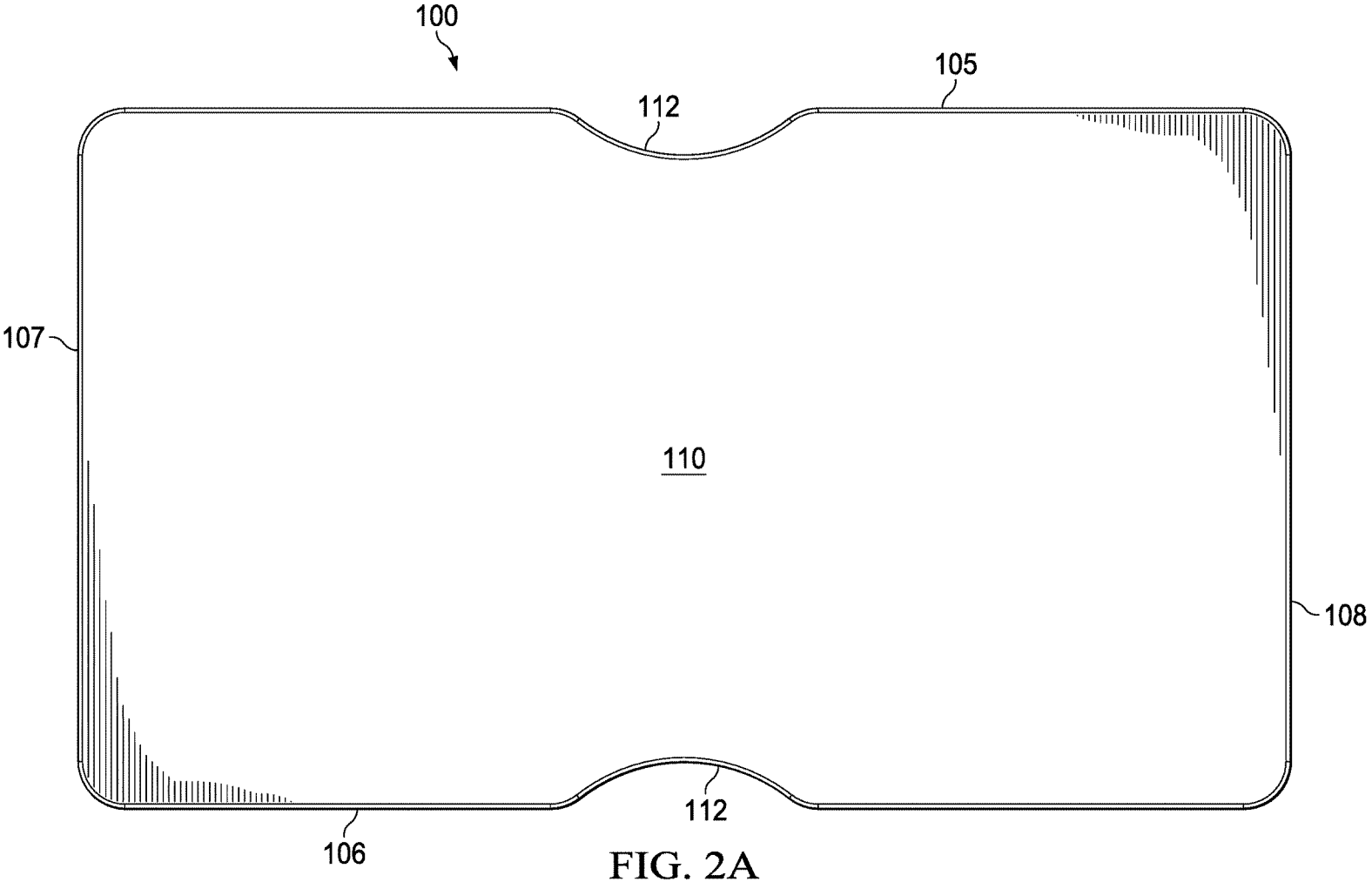
FIG. 2A illustrates a top view of an implementation of the example desk illustrated in FIG. 1.
Figure 2B:
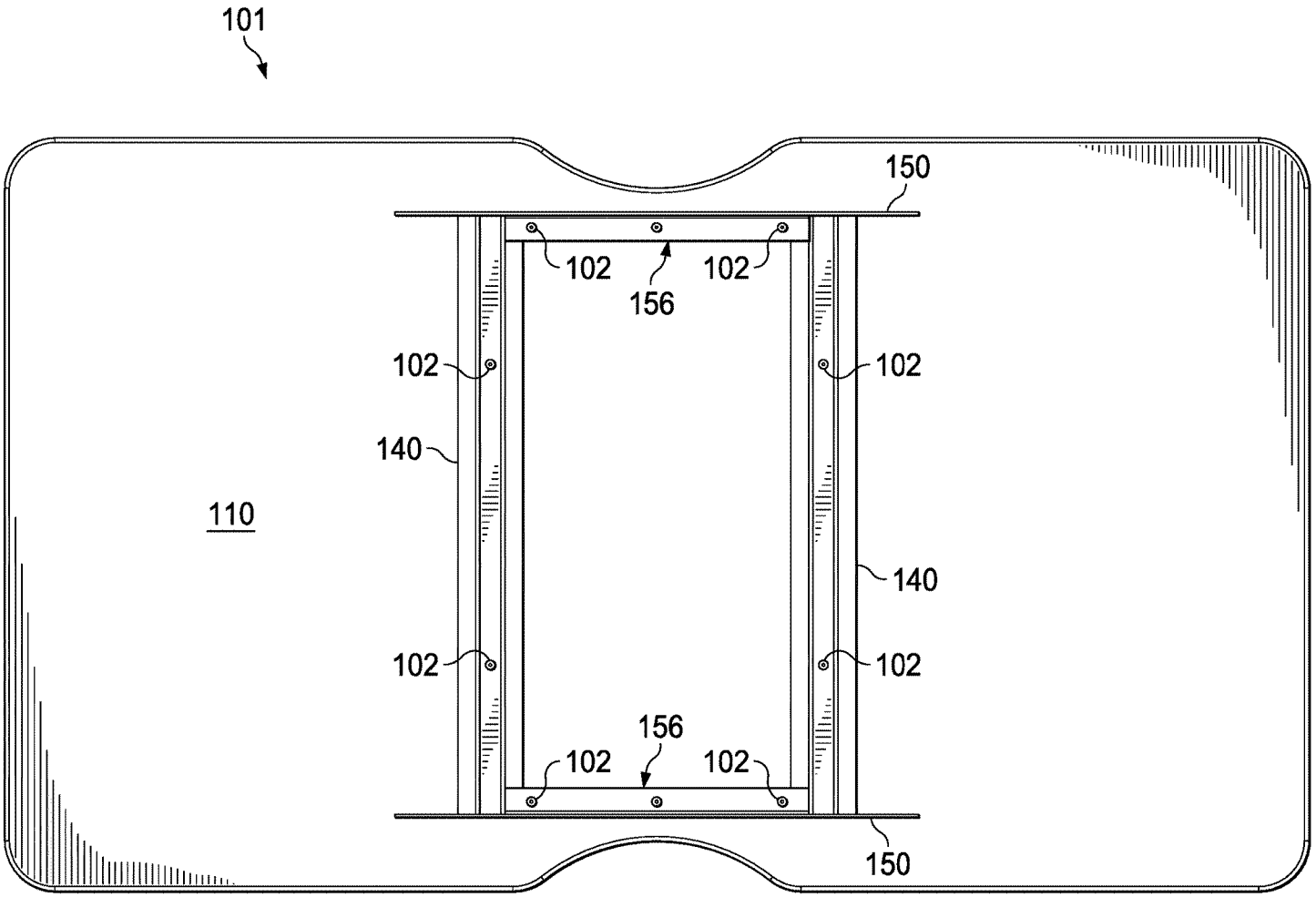
FIG. 2B illustrates a cross-sectional view of an implementation of a portion of the desk, illustrated in FIG. 2A, that includes the underside of the table top.

The desk 100 may include a table top 110 and an organizational frame 120. FIG. 2A illustrates an top view of the example desk, illustrated in FIG. 1; and, FIG. 2B illustrates a cutaway view of a bottom of the example desk, illustrated in FIG. 1. A table top may be disposed on and/or coupled to the frame of the table. The table top may be fixedly or adjustably coupled to the frame. For example, as illustrated in FIG. 2B, fasteners 102 may couple the table top 110 to the frame 120 (e.g., via brackets 140). In some implementations, the table top may be coupled to the frame to allow vertical height adjustment, lateral adjustment, and/or rotational adjustment.

The table top may be any appropriate size, shape, and/or material as appropriate. A table top may be disposed approximately parallel to a surface on which the desk is disposed (e.g., as illustrated in FIG. 1) and/or at an angle (e.g., relative to a vertical axis perpendicular to the surface on which the desk is disposed). In some implementations, the table top may be coupled to the frame such that adjustment of the orientation of the table top relative to the frame and/or ground on which the desk is disposed may be adjusted. For example, the desk may include an adjustable table top as described in U.S. 20160324309 which is hereby incorporated by reference.

In some implementations, the table top 110 may include cutouts 112. A cutout may facilitate access to organizational tools, facilitate movement of the desk and/or inhibit pinching of extremities when moving the desk (e.g., a desk may be lifted by the cutout and placed against a wall or other desk while inhibiting pinching of fingers between contacting surfaces).

The organizational frame of a table may include two or more legs 130 and one or more organizational members. As illustrated in FIGS. 1-4B, a desk 100 may include four legs 130 and two organizational members 150. The organizational member 150 may be disposed between at least two of the legs of the table. For example, as illustrated in FIG. 2A, a table may include 2 sets of opposing sides. A first set of sides may include first side 105 and opposing side 106. A second set of sides may include third side 107 and opposing side 108. The sets of sides may be or may not be approximately perpendicular to each other based on the shape of the table top 110. A first organizational member may be disposed between legs proximate the first side 105 and a second organizational member may be disposed between legs proximate the second side 106, in some implementations.

The legs 130 of the organizational frame 120 may have any appropriate size and/or shape. A leg may or may not have an approximately uniform cross-sectional shape across a height of the leg. A leg or a portion thereof may be approximately vertical. A leg or portion there of may be slanted (e.g., when compared to a vertical axis that extends between a surface on which the table is disposed and a table top). As illustrated in FIGS. 1, 3, 4A, and 4B a leg may include one or more slanted portions and one or more vertical portions. A slanted portion may be a portion of a leg that is disposed at an angle (e.g., slanted) when compared to a vertical axis that extends between a surface on which the table is disposed and its table top. A vertical portion may be a portion of a leg that is approximately vertical (e.g., approximately perpendicular to a surface on which the table is disposed).

Figure 4A:
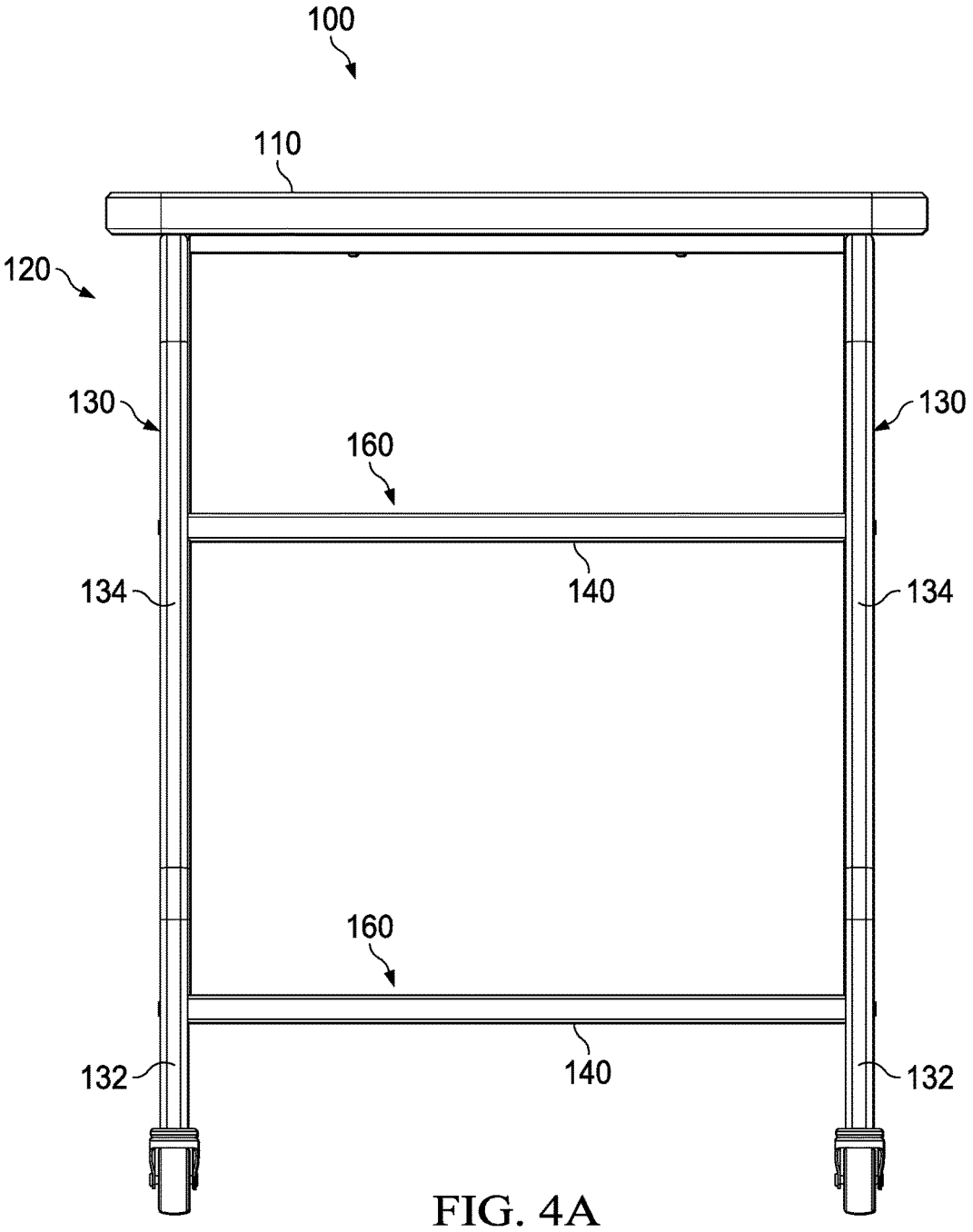
FIG. 4A illustrates a side view of an implementation of the example desk illustrated in FIG. 1.
Figure 4B:
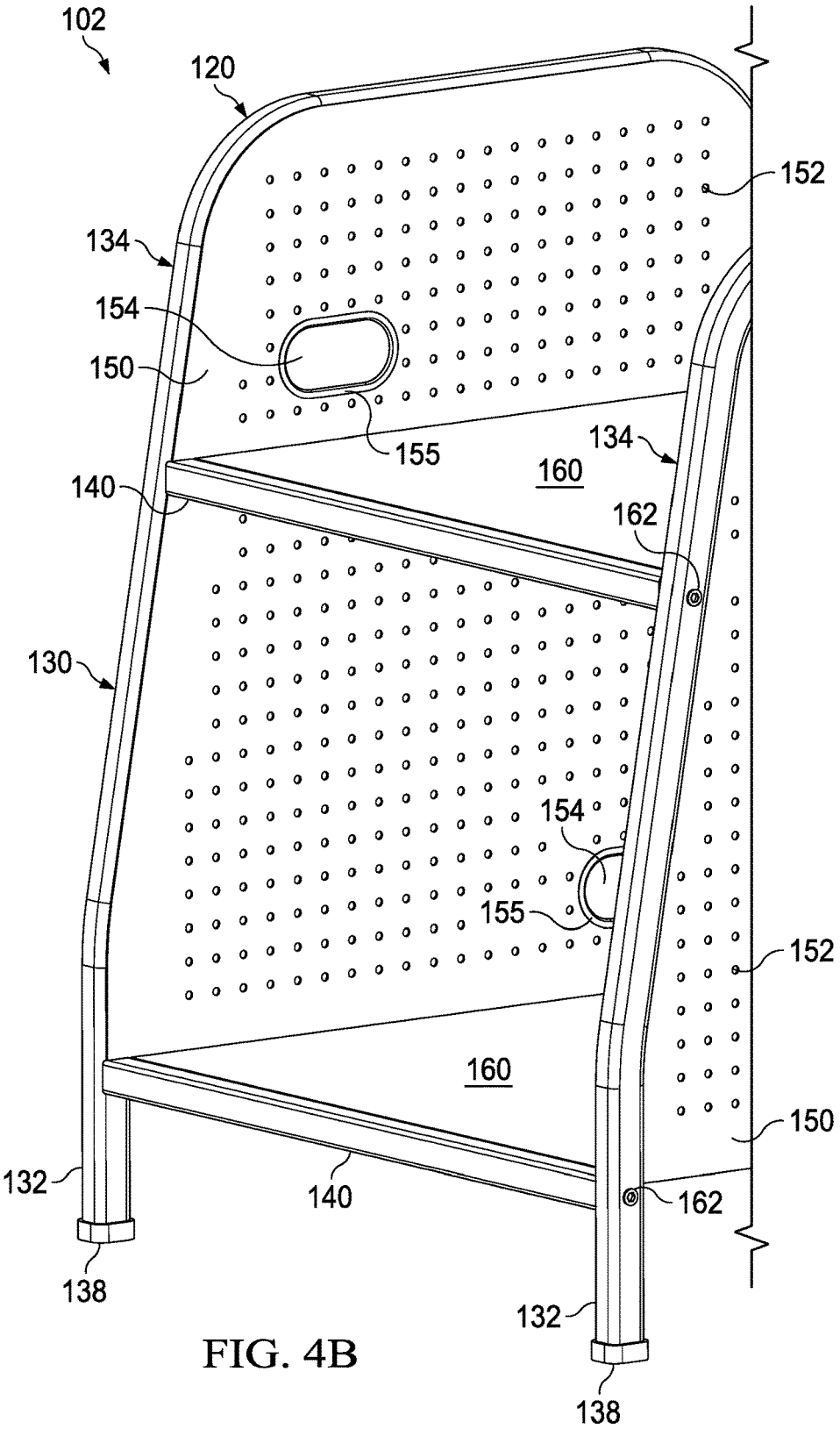
FIG. 4B illustrates a side perspective view of an implementation of the example desk illustrated in FIG. 4A.

As illustrated in FIG. 4B, a leg may include at least one slanted portion proximate a top side 121 of the frame 120 and at least one vertical portion proximate a bottom side 122 of the frame. In some implementations, the frame may be a narrowing frame and may narrow proximate the top side 121 of the frame 120 (e.g., relative to the bottom side 122 of the frame). As illustrated the portions of the legs proximate the top side 121 of the frame may be closer together than the portions of the legs proximate the bottom side 122 of the frame. A narrowing frame may increase comfort of users when compared to a desk in which the frame is not narrowing. For example, more room for a users' legs and/or knees may be provided with a narrowing frame than a frame with vertical legs and a similar footprint.

One or more of the legs 130 may be adjustable in height. For example, a leg may be telescoping. A leg may be extended to a height and locked into place (e.g., via a pin). A leg may include an adjustable height leg similar to the leg described in U.S. Pat. No. 8,622,355, which is incorporated by reference.

Figure 3:
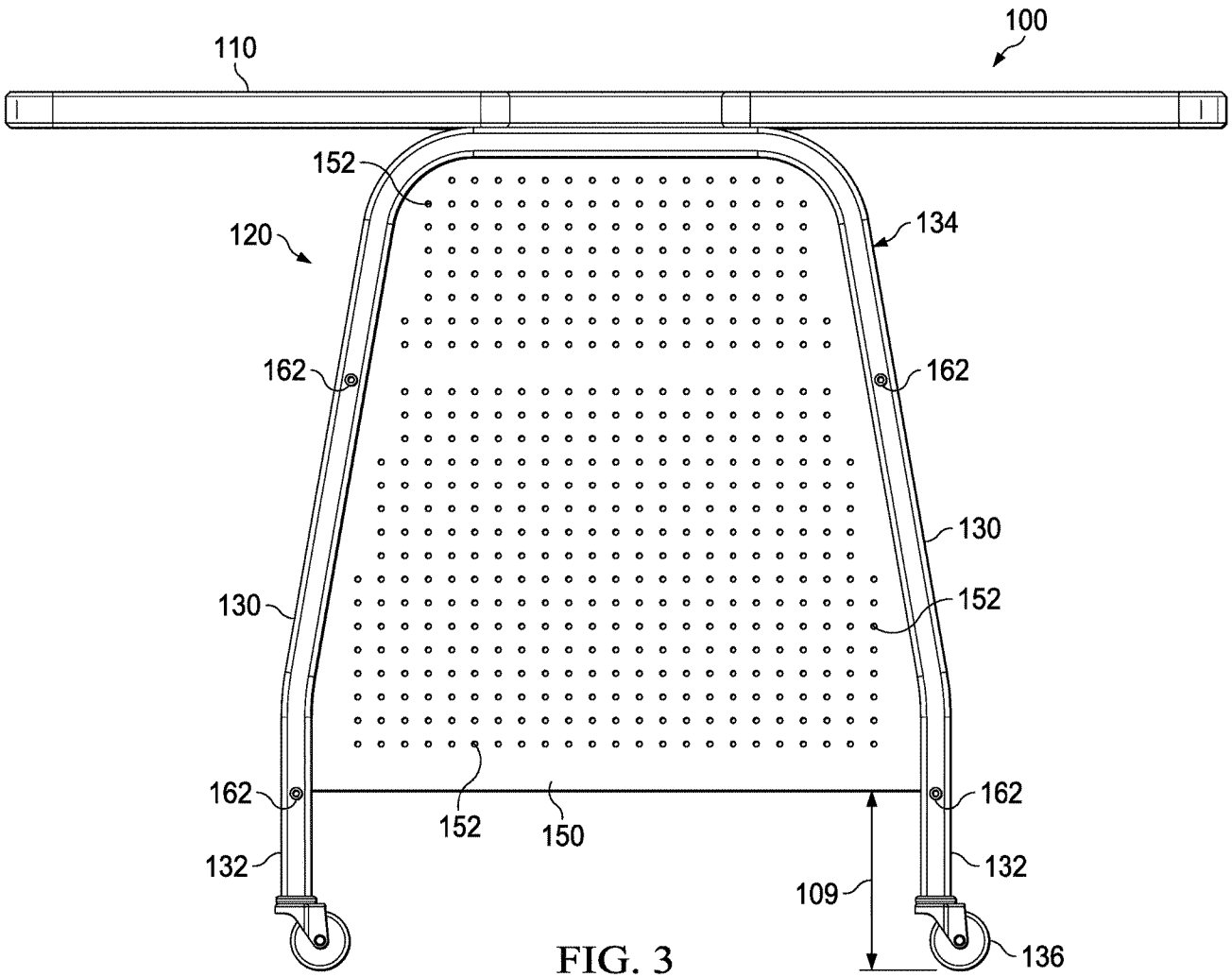
FIG. 3 illustrates a back view of an implementation of the example desk illustrated in FIG. 1.

One or more of the legs 130 may include one or more casters 136 (e.g., locking and/or non-locking) or other mobility devices (e.g., glider feet to facilitate sliding). Casters may facilitate movement of the desk. As illustrated in FIG. 3, a desk may include casters 136 and/or, as illustrated in FIG. 4B, a desk may include feet 138.

The frame 120 may include brackets 140. As illustrated in FIG. 4B, bracket(s) may be coupled to leg(s) via fastener(s) 162. One or more of the brackets 140 may or may not provide structural support to the frame 120. For example, a cross-member bracket may be disposed between two opposing legs (e.g., in different sets, not coupled via an organizational member, etc.). The cross-member bracket may stiffen the frame to inhibit rotation and/or collapse of the frame during use and/or transport. In some implementations, a frame 120 may include a top bracket disposed proximate a top side 121 of the frame 120. In some implementations, a table top may be disposed on one or more of the top brackets (e.g., with or without coupling the table top to the frame). As illustrated in FIG. 2B, a top bracket 140 may couple to a table top 110 via fasteners 102.

In some implementations, the desk 100 may include one or more shelves 160. A shelf may have any appropriate size and/or shape. As illustrated in FIG. 4B, a shelf 160 may be disposed between brackets 140. The shelf 160 may be coupled to the brackets 140 via any appropriate coupling (e.g., adhesive, bonding, welding, fusing, and/or fastening). A shelf may extend to the organizational member(s) 150 such that it contacts and/or couples with the organizational member(s). A shelf may extend at least partially along the length and at least partially along the width of the organizational member. A shelf may allow, for example, storage of any appropriate objects such as storage of supplies for use with project, textbooks, instructions, equipment, etc. A shelf may increase organizational capabilities of furniture with an organizational frame.

In some implementations, the desk 100 may include one or more drawers (not shown). A drawer may have any appropriate size and/or shape. A drawer may be disposed between brackets. In some implementations, a drawer may be disposed proximate a shelf (e.g., below at least a portion of a shelf). The shelf 160 may be coupled to the brackets 140 via any appropriate coupling (e.g., adhesive, bonding, welding, fusing, and/or fastening). A shelf may extend to the organizational member(s) 150 such that it contacts and/or couples with the organizational member(s). The drawer may extend at least partially along the length and at least partially along the width of the organizational member and/or a shelf proximate the drawer. A drawer may allow, for example, storage of any appropriate objects such as supplies for use with project, textbooks, instructions, equipment, etc. A drawer may include lock(s) (e.g., to secure objects store in the drawer). A drawer may increase organizational capabilities of furniture with an organizational frame and/or allow secure storage of objects (e.g., high value objects, objects frequently stolen, important objects, etc.).

In some implementations, the shelf and/or drawer may include organizational inserts placed in, coupled to, and/or disposed in the shelf and/or drawer. For example, an organizational block may allow storage of sorted objects, such as building block, brushes, spools, paints, beads, wires, instructions, etc. The organizational insert may include vertical and/or horizontal walls (e.g., to allow vertical and/or horizontal storage of objects). For example, an organizational insert may include dividers (e.g., that allow storage of books and/or instructions) and/or cubbies (e.g., that allow storage of building blocks, paints, brushes, tools, etc.).

The organizational member may be any appropriate size and/or shape. The organizational member may be linear (e.g., in a plane disposed between the legs to which the organizational member is coupled) and/or not linear (e.g., include curved section(s)). The organizational member may extend to the top of the frame, as illustrated in FIG. 3, and/or a gap may be disposed between a portion of an organizational member and other portions of the frame (e.g., bracket and/or legs) and/or the table top. A gap 109 may be disposed between a portion of the organizational member and the location on which the table is disposed (e.g., the ground). In some implementations, the organizational member may be coupled to the table top. As illustrated in FIG. 2B, an organizational member 150 may be coupled to a table top 110 and/or brackets 140 via fasteners 102. For example, an organizational member may include a flange 156. The flange 156 may at least partially support a table top disposed on proximate a top side 121 of the frame 120 and/or couple (e.g., via fasteners 102, welding, and/or any other appropriate coupling) with a table top disposed proximate a top side of the frame.

The organizational member 150 may be coupled to other portions of the organizational frame 120 via any appropriate coupling member (e.g., fasteners, openings, hooks, pin and socket, adhesive, welding, fusing, etc.). The organizational member may be coupled to legs 130 (e.g., as illustrated in FIG. 3), braces 140 (as illustrated in FIG. 1), and/or a table top (e.g., as illustrated in FIG. 2B).

The organizational member 150 may include a plurality of coupling members 152 (e.g., recesses, openings, protrusions such as pegs and/or hooks, etc.). The coupling members 152 may be disposed across a surface of the organizational member 150 or a portion thereof. As illustrated, the coupling members of the organizational member 152 may include openings. The openings may be any appropriate shape(s) (e.g., circular, oval, square, other regular shapes, irregular shapes and/or combinations thereof). The coupling members 152 may be disposed on the organizational member in any appropriate pattern and/or disposed irregularly on the organizational member. Coupling member(s) may be capable of coupling with an organizational tool. For example, an opening through the organizational member may receive a protrusion of the organizational tool. As another example, a protrusion of the organizational tool may receive a loop or opening of an organizational tool.

An organizational tool may include any appropriate organizational tool. For example, organizational tools may include one or more containers (e.g., buckets, bins, cubbies), hooks (e.g., s-hooks, c-hooks, etc.), pegs, writing surfaces (e.g., chalkboard, white board, electronic writing display, etc.), shelves, magnetic bars (e.g., to couple magnetic objects to the organizational member), display device holders, brackets (e.g., sliding, L-shaped, C-shaped, etc.), bags, and/or any other appropriate organizational tool. An organizational member may include one or more organizational coupling member (e.g., protrusions such as hooks and/or pegs, loops, ties, recesses, tracks etc.) that is capable of coupling with one or more of the coupling members of the organizational member. The organizational coupling member of a tool may be configured to mate with one or more coupling member of the organizational member (e.g., slot and bar, pin and hole, bolt and opening, hook and opening, peg and loop, track and traveling member, etc.). The organizational coupling member may be rigid, semi-rigid, and/or flexible. The organizational coupling member of the tool may be capable of supporting the weight of the tool when coupled to the organizational member. The supplies such as school supplies, art supplies, project supplies, and/or other objects may be disposed in the organizational tool. Storing the supplies in the organizational tool may increase user satisfaction (e.g., since supplies are easily stored, accessed and organized) and/or increase useable area on a table top (e.g., since containers on the table top may not be utilized).

Figure 5:
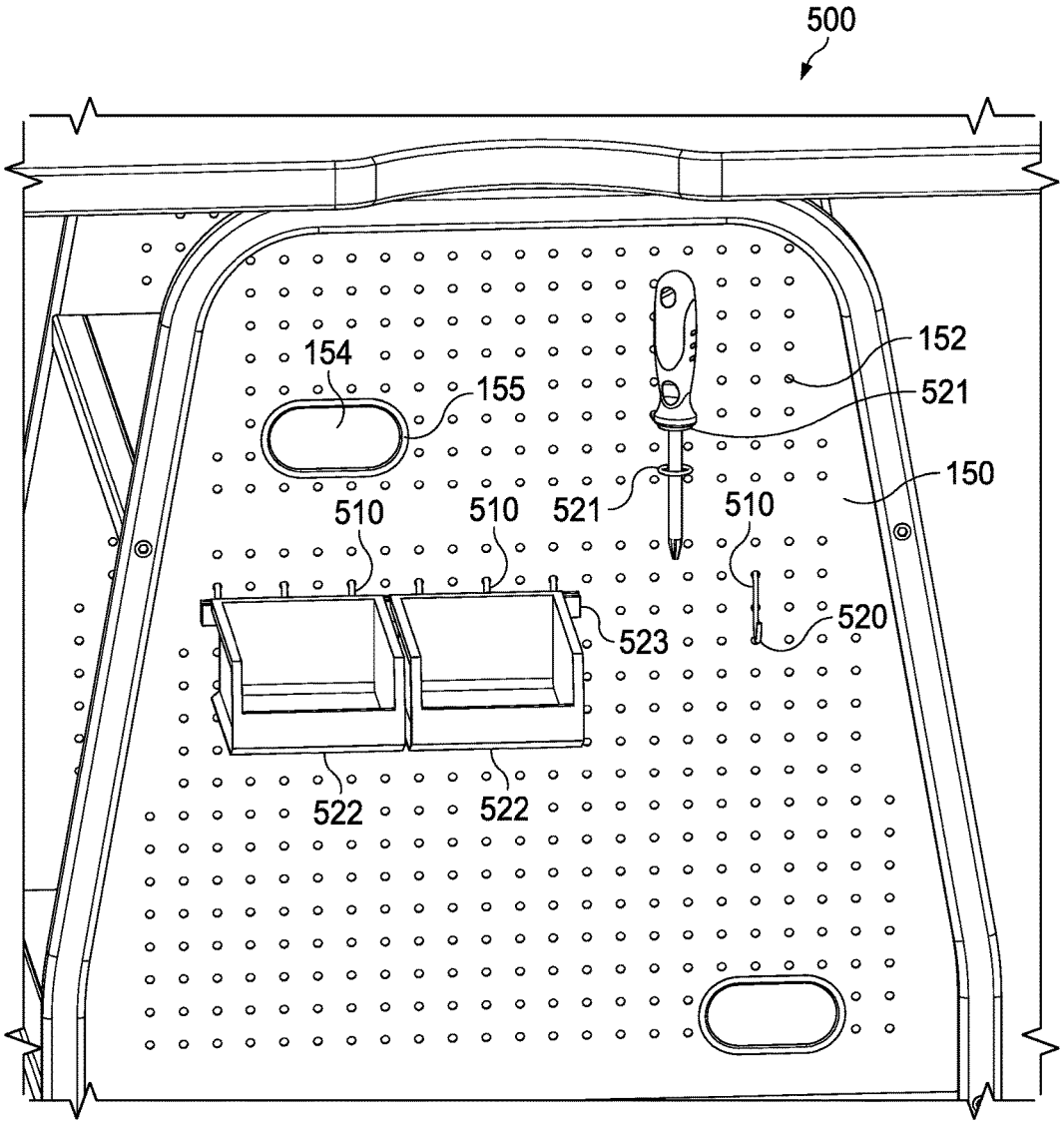
FIG. 5 illustrates an implementation of an example portion of a desk with example organizational tools.

FIG. 5 illustrates an implementation of an example portion 500 of furniture with an organizational frame. As illustrated, the organizational member 150 includes openings as coupling members 152. Protrusion(s) 510 of organizational tools 170 may be received and/or retained by the opening(s) in the organizational member 120. As illustrated organizational tools may include hook(s) 520, loop(s) 521, and/or containers 522 directly or indirectly coupled to the organizational member.

In some implementations, an organizational coupling member (e.g., directly or indirectly coupled to a tool and/or organizational member) tool may include one or more protrusions. A protrusion may be disposed at least partially in an opening of the organizational to couple the organizational tool to the organizational member. For example, the protrusion may include an s-hook, c-hook, L-hook, t-bracket, etc. The protrusion(s) may be capable of coupling with opening(s) of the organizational member such that the organizational tool is retained in a position until a user removes the organizational tool (e.g., unhook the tool).

Figure 6:
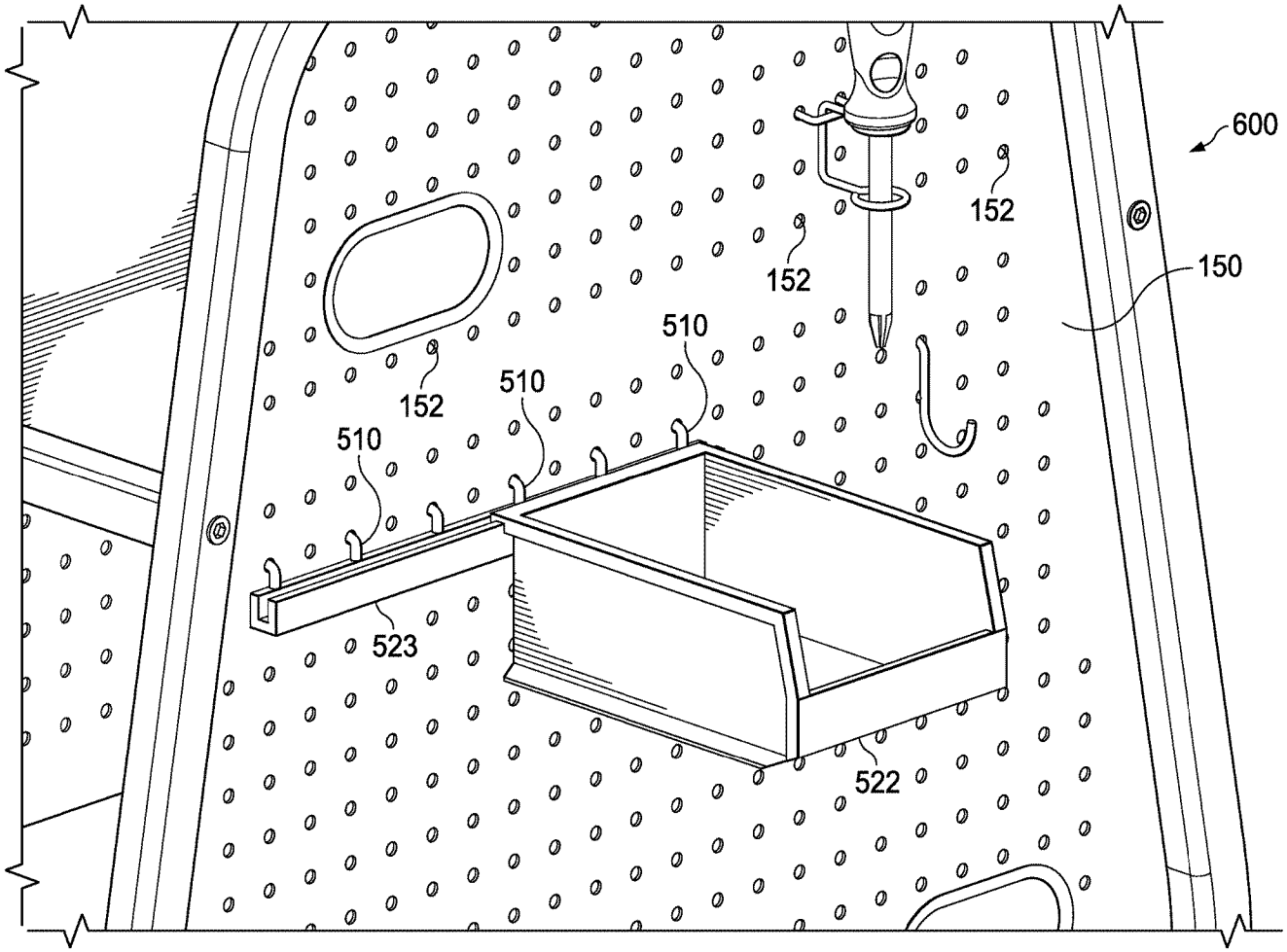
FIG. 6 illustrates an implementation of an example portion of a desk with example organizational tools.

In some implementations, one or more organizational tools may be used to indirectly couple an organizational tool and/or other tool to the organizational member. For example, as illustrated in FIG. 5, a set of loops may be utilized to retain a driver and a bracket 523 may be utilized to retain containers 522. FIG. 6 illustrates an implementation of an example portion 600 of furniture with an organizational frame. As illustrated, the organizational coupling member 151 may coupled with coupling members (e.g., openings) 152 of an organizational member 150. The organizational coupling members 152 may allow a bracket 153 to be coupled to organizational member. The bracket may allow containers 522 and/or other tools to be hooked onto and/or slid onto the bracket to couple indirectly with the organizational member. A slidable bracket may allow the bracket body to be coupled to a set of coupling members of the organizational member and a portion of the bracket to slide to another position (e.g., to increase positional flexibility). A bracket may allow tools (e.g., organizational tools) to be slid along the bracket to adjust positioning, to make room for additional tools, and/or for removal.

Figure 7:
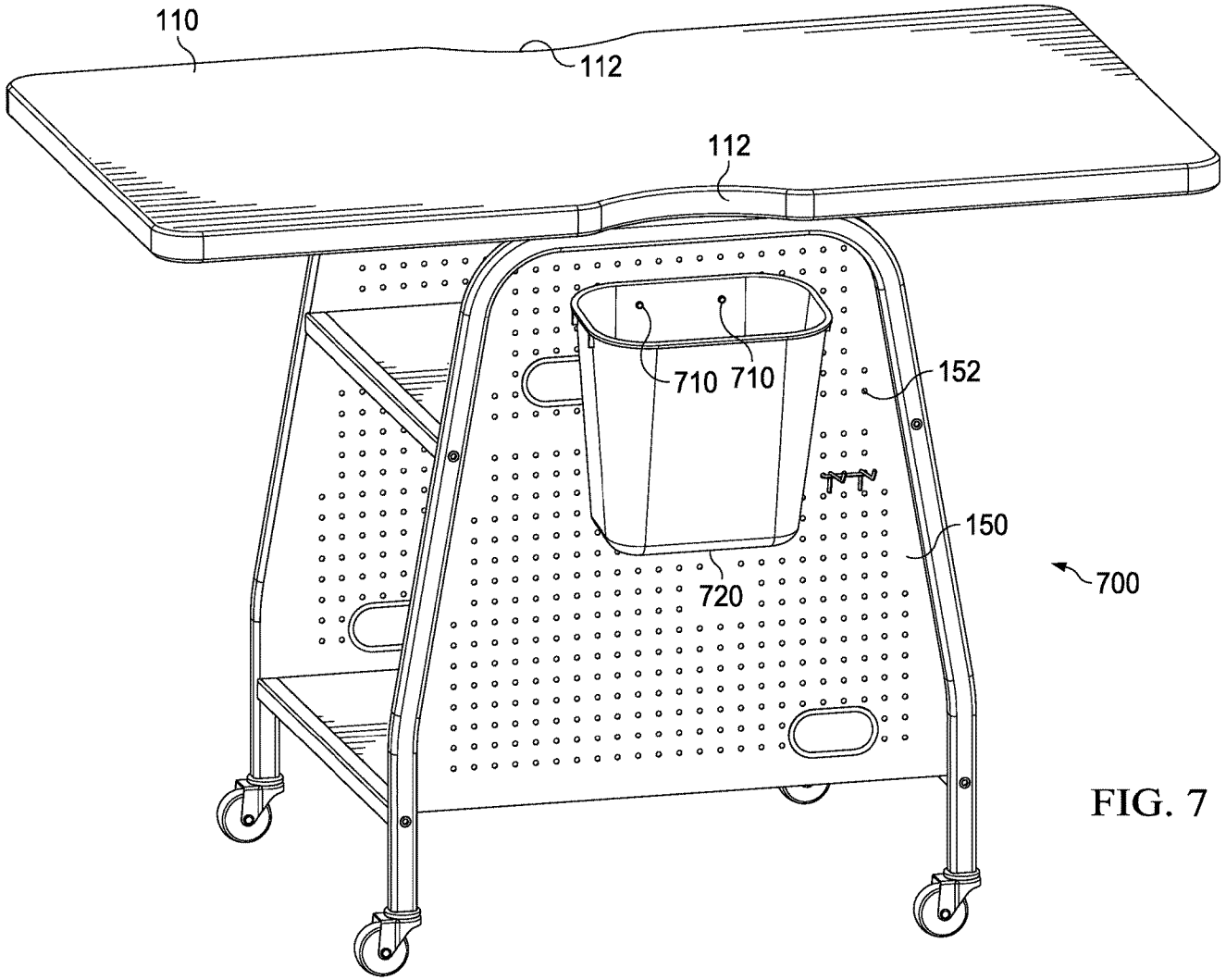
FIG. 7 illustrates an implementation of an example portion of a desk with example organizational tools.

As another example, a set of hooks may be utilized to retain an organizational tool. In some implementations, an organizational tool may include a set of hooks to couple with the organizational frame. FIG. 7 illustrates an implementation of an example portion 700 of a desk with an organizational frame. As illustrated, a set of hooks 710 is coupled to a basket 720. The hooks extend from the basket to allow the hooks to couple with openings in the organizational member. In some implementations, the basket may be a wastebasket and/or may be positioned proximate cutouts 112 in a table top to facilitate use (e.g., a user may push trash, excess material, excess supplies, etc. towards the cutout). In some implementations, positioning a basket proximate a cutout may allow access to the basket even if when the side of the organizational member to which the basket is coupled is not fully accessible (e.g., the desk is pushed against another desk and/or wall). The basket may be removed to redistribute captured supplies into other containers (e.g., coupled or not coupled to the organizational member) and/or dispose of waste.

In some implementations, other components may be coupled to the organizational member. For example, signs (e.g., motivational, label, etc.), instructions (e.g., directly or indirectly for example via a loop attached to instructions), decorations, etc. may be coupled to openings in the organizational member via couplers on the other components.

In some implementations, the organizational member 150 may include apertures 154. The apertures 154 may be disposed at least partially through the organizational member 150. An aperture may facilitate movement of the desk (e.g., by allowing a user to grip the frame via the aperture). In some implementations, a covering 155 may be provided at least partially on the aperture (e.g., at least partially around a perimeter and/or at least partially through the aperture). The covering 155 may facilitate gripping, may provide a cushioned grip, inhibit degradation of exposed surfaces in the aperture, provide a smooth surface to inhibit injury while gripping the surface, and/or any have other appropriate purpose.

FIGS. 1-4B illustrate an implementation of a desk, but other furniture implementations may include one or more of the described features. A desk may or may not include one or more of the described and/or illustrated features. In some implementations, other features may be included. Although the desk illustrated in FIG. 1 illustrates a desk that allows more than one user to be seated proximate the desk, a table and/or desk may be larger (e.g., to allow more than two users to be seated or standing about the desk) and/or smaller (e.g., sized for one user).

In some implementations, leg(s) and/or brace(s) may include coupling members that allow organizational tools to be directly coupled to the legs. For example, in place of and/or in additional to one or more of the organizational member(s) of furniture, leg(s) and/or brace(s) may include coupling members, such as openings, that are capable of coupling with tools, such as organizational tools (e.g., hooks, containers, and/or loops).

In some implementations, a table, such as a desk or any other appropriate table, may include more than 4 legs and/or may include less than four legs. For example, a table may include 3 legs and/or 2 legs. An organizational plate may be disposed between at least two of the legs. A leg may be directly coupled to one or more than one organizational plate. As illustrated in FIG. 1, each leg is directly coupled to one organizational plate. In some implementations, a leg may be coupled to more than one leg. For example, in a table with three legs, one leg may be coupled to 2 organizational members that are each coupled to one of the other legs.

In various implementations, the materials utilized to make components of the furniture may vary or be the same. In some implementations, the material selected may be based on the component and/or use of the furniture. For example, the legs may include a material selected to support the weight of the furniture and/or use of the furniture by users. The table top may include a material selected for ease of cleaning, to minimize interference with projects (e.g., non-electrically conducting), etc. As another nonlimiting example, a coating may be utilized to provide functionality to tabletops and free-standing boards, such as materials that allow the coated surface to be used as a smart screen, projection screen, writing surface (e.g., white board and/or chalk board), cork board, etc.

In some implementations, although the coupling members of the organizational member are illustrated as the same across a surface of an organizational member, the types of coupling members may vary. For example, a surface of an organizational member may include openings through the organizational member and one or more other types of organizational members, such as protrusions (e.g., hooks, loops, and/or pegs). Varying the type of organizational member may provide compatibility versatility of the organizational member since different connections may be used. In some implementations, the same type of coupling member may be utilized across a surface of the organizational member to allow positioning versatility since a compatible organizational tool may be positioned based on user desire rather than inhibited by the arrangement of the coupling members on the surface of the organizational members.

Organizational tools may be fixedly (e.g., via toggle fasteners, such as toggle bolts) and/or removably (e.g., via hooks) coupled to the organizational member.

In some implementations, the desk may not include shelves.

In some implementations, a table (e.g., a desk) may include a table top is coupled to a frame. The frame includes four legs. The frame includes a first side with two legs and a second opposing side with an additional two legs. A first organizational member is disposed between the legs on the first side and/or a second organization plate is disposed between the legs on the second side. The organizational member may be coupled to the legs via fastener(s) and/or via any other appropriate coupling (e.g., glue, slot and tongue, etc.). As illustrated, a leg includes a slanted section (e.g., curved and/or linear) and a straight section. The legs may be disposed farther apart proximate a floor than proximate a table top (e.g., to increase stability, to increase user leg room, etc.). The legs may include one or more braces coupled (e.g., via a fastener) between legs on opposing sides. As illustrated, the openings in the organizational member may be utilized to couple organizational tools to the legs via the organizational member. As illustrated, a hook may be utilized to couple scissors, cubbies may coupled to the plate, and/or extended hooks (e.g., racks) may be coupled to the plate.

In various implementations, a table, such as a desk may include a table top coupled to a frame. The frame may include legs and at least one organizational member disposed between the legs. The frame may include at least one brace between the legs. The organizational member may include a plurality of openings. The opening(s) in the organizational member may be able to couple with organization tools (e.g., pegs, hooks, containers, writing surfaces, etc.).

In some implementations, the frame for a table may include two legs and an organizational member disposed between the legs. At least one of the legs may two or more feet. For example, the leg may include a C-shaped member proximate the bottom side of the frame such that the ends of the C contact a ground on which the table is disposed. The C-shaped member may include curved sections and/or straight sections.

In some implementations, the table top may include features such as nests (e.g., to store media devices), grooves (e.g., to retain writing devices), ledges (e.g., to support media devices such as books, instruction manuals, and/or electronic devices). The desk may include wire management members (e.g., clips, openings in components, etc.), and/or connectivity ports (e.g., power, data, etc.). In some implementations, one or more of the desktop organization features as described in U.S. Pat. No. 9,565,928, which is hereby incorporated by reference, may be included in the table top and/or furniture. For example, the table top may include a desk sleeve with a pivot panel, sleeve, nest, ledges, wire management, etc.

In some implementations, a desk may include a kickstand base. For example, a kickstand base may be similar to the kickstand base described in U.S. Pat. No. 9,226,579. The kickstand base may be coupled to the frame such that it at least partially contacts a surface of a location on which the desk is located (e.g., when the desk is disposed on the surface of the location, when a force to tilt the desk is applied to the desk, and/or when the desk is tilted to inhibit the desk from falling). For example, the kickstand base may be disposed proximate the second sections and the third sections of the C-shaped spine members. The kickstand base may be disposed on the third section and/or proximate the second section (e.g., which is disposed proximate a surface of the location on which the desk is disposed).

In various implementations, the table (e.g., the desk) or portions there of may include any appropriate material, may be any appropriate size, and/or may be any appropriate shape.

Although desk has been described and illustrated in FIGS. 1-4B as an example of furniture with an organizational frame, other furniture may include one or more similar features and/or may include one or more different features. In some implementations, the described and/or illustrated features may be included on any other appropriate table (e.g., dining table, library table, conference table, work table, architectural drafting table, etc.) and/or any other appropriate furniture. For example, a table for storing equipment such as computers, printers, etc. may include one or more similar features. As another example, a worktop may include one or more similar features.

Although an example of furniture with an organizational frame has been illustrated as a desk, other appropriate types of furniture may include one or more similar features of the desk described and illustrated in FIGS. 1-4B and/or may include one or more different features. Furniture may include furniture including, but not limited to, tables (e.g., desks), freestanding boards, etc.

Figure 8A:
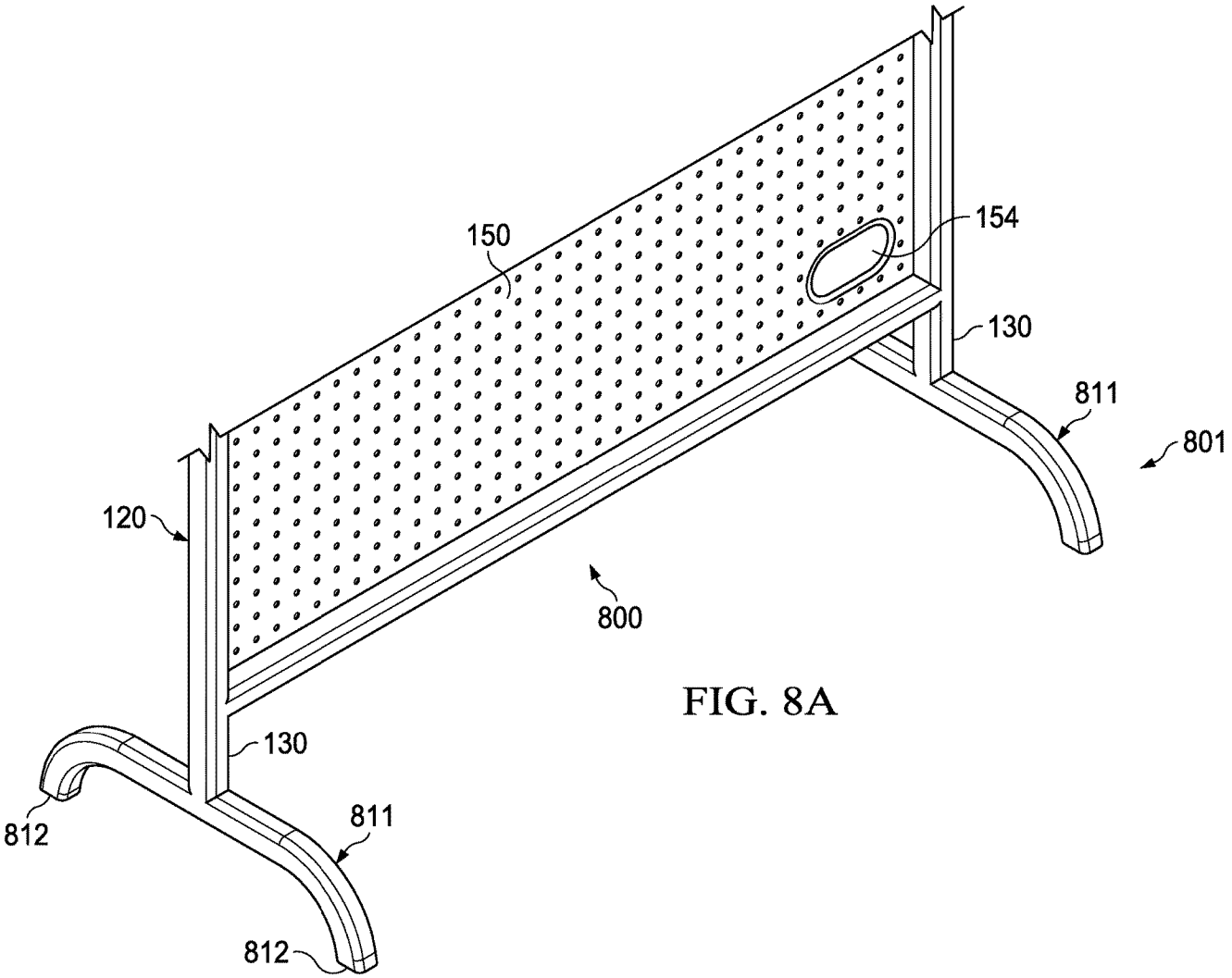
FIG. 8A illustrates an implementation of an example portion of furniture.

In some implementations, furniture may include an organizational frame similar to the described desk organizational frame. For example, furniture may include an organizational frame 120. FIG. 8A illustrates an implementation of an example piece of furniture. The frame 120 may include at least one set of legs and an organizational member 150 disposed between the legs. The legs may be any appropriate legs, such as C-shaped legs. As illustrated, a C-shaped leg may include a c-shaped member 811 and feet 812 proximate ends of the c-shaped member. The C-shaped member may include curved sections and/or straight sections. The organizational member 150 may be coupled proximate the ends of the organizational member 150 to the legs 130. In some implementations, one or more legs may be coupled to the organizational member 150 not proximate an end of the organizational member. The organizational member may include coupling members 152 to allow one or more organizational tools (not shown) to be coupled to the organizational member and/or one or more apertures 154 to facilitate movement of the furniture.

Figure 8B:
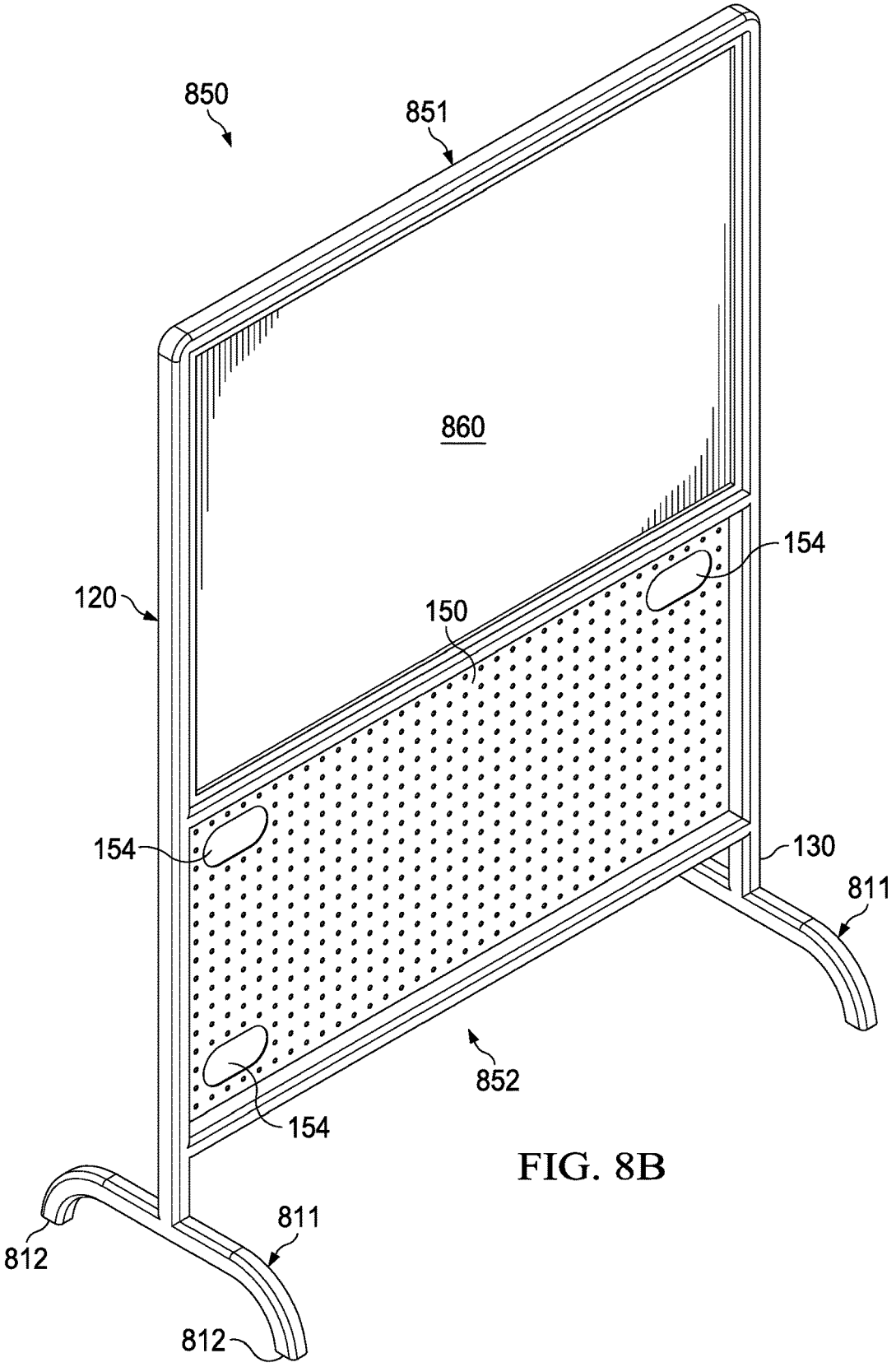
FIG. 8B illustrates an implementation of a freestanding board.

The frame may be coupled to any appropriate components of the furniture, such as a table top, a board (e.g., smart board, writing board, easel surface, projector screen, etc.). FIG. 8B illustrates an implementation of an example of a freestanding board 850. The freestanding board may include a writing board, such as a white board, paper holder, paper, chalkboard, smart board, etc. The freestanding board may include a screen, in some implementations. As illustrated, the freestanding board 850 may include a frame 120 coupled to a board 860. The frame 120 may include legs 120. One or more of the legs 120 may include a c-shaped member 812 disposed proximate an end of the leg (e.g., the end proximate the surface on which the freestanding board is disposed). The c-shaped member 811 may include feet 812 proximate each end of the c-shaped member. The feet 812 may contact on a surface on which the freestanding board is disposed.

An organizational member 150 may be coupled to the legs 130 of the frame 120 (e.g., proximate an end of the organizational member, as illustrated, and/or not proximate an end of the organizational member). The organizational member 150 may include one or more coupling members 152, to allow coupling of one or more organizational tools to the organizational member, and/or aperture(s) 154.

A board 860 may be coupled to the frame in any appropriate orientation. The board 860 may be coupled to a top side of the frame, a bottom side of the frame, in the frame, etc. As illustrated, the board 860 may be coupled to the frame 120 such that the board 860 is disposed proximate the top side 851 of the freestanding board 850. In some implementations, the board may be disposed proximate the bottom side 852 of the frame and the organizational member 150 may be disposed proximate the top side 851 of the freestanding board.

The board 860 may have any appropriate shape including planar and non-planar shapes (e.g., curved surface). The board may include materials (e.g., as coating, layer, and/or portion of the board) that allow functionality for a purpose such as writing, viewing (e.g., media on the board), etc. For example, the board may include a white board, chalk board, paper, paper holder, screen (e.g., onto which a projector may project media and/or on which media can be displayed).

Although the board and the organizational member are described an illustrated as being disposed one component on top of the other component, other orientations may be utilized with furniture, including the freestanding board. For example, a board and an organizational member may be disposed side by side (e.g., such that the board and the organizational member are disposed between at least two of the legs of the frame and/or a bracket). In some implementations, one or more freestanding boards may include more than one board and/or organizational frame. For example, an organizational member may be disposed between boards and/or a board may be disposed between organizational members.

Although an implementation of the freestanding board is described and illustrated in FIG. 8B, a freestanding board may not include all of the described features and/or may include additional features. For example, freestanding board is illustrated as including two legs, but more than two legs may be included (e.g., 3 legs, 4 legs, etc.). As another example, the freestanding board may include a ledge (coupled to the frame, coupled via the organizational member, and/or coupled to another component of the furniture). A ledge may, for example, allow storage of writing utensils, media devices, pointers, etc. In some implementations, one or more ledges may be disposed between the board(s) and the organizational member(s). Ledge(s) may be disposed on the board(s) and/or on the organizational member(s).

In some implementations, furniture (e.g., desks, freestanding boards, easels, etc.) may include L-shaped legs. For example, the frame may include two or more legs that are L-shaped spine members. The L-shaped leg may include a first approximately vertical section and a second section that is disposed proximate a surface of the location on which the furniture is disposed. The first section may be coupled to other component(s) of the furniture (e.g., board, table top, etc.) proximate a first end and a second end may be coupled to the second section of the leg (e.g., proximate an end of the second section). In some implementations, the leg may be T-shaped with a first section approximately vertical section and a second section disposed proximate a surface of the location on which the furniture is disposed. The first section may be coupled to other component(s) proximate a first end and may be coupled at a second end to the second section of the leg (e.g., proximate a middle).

Figure 9:
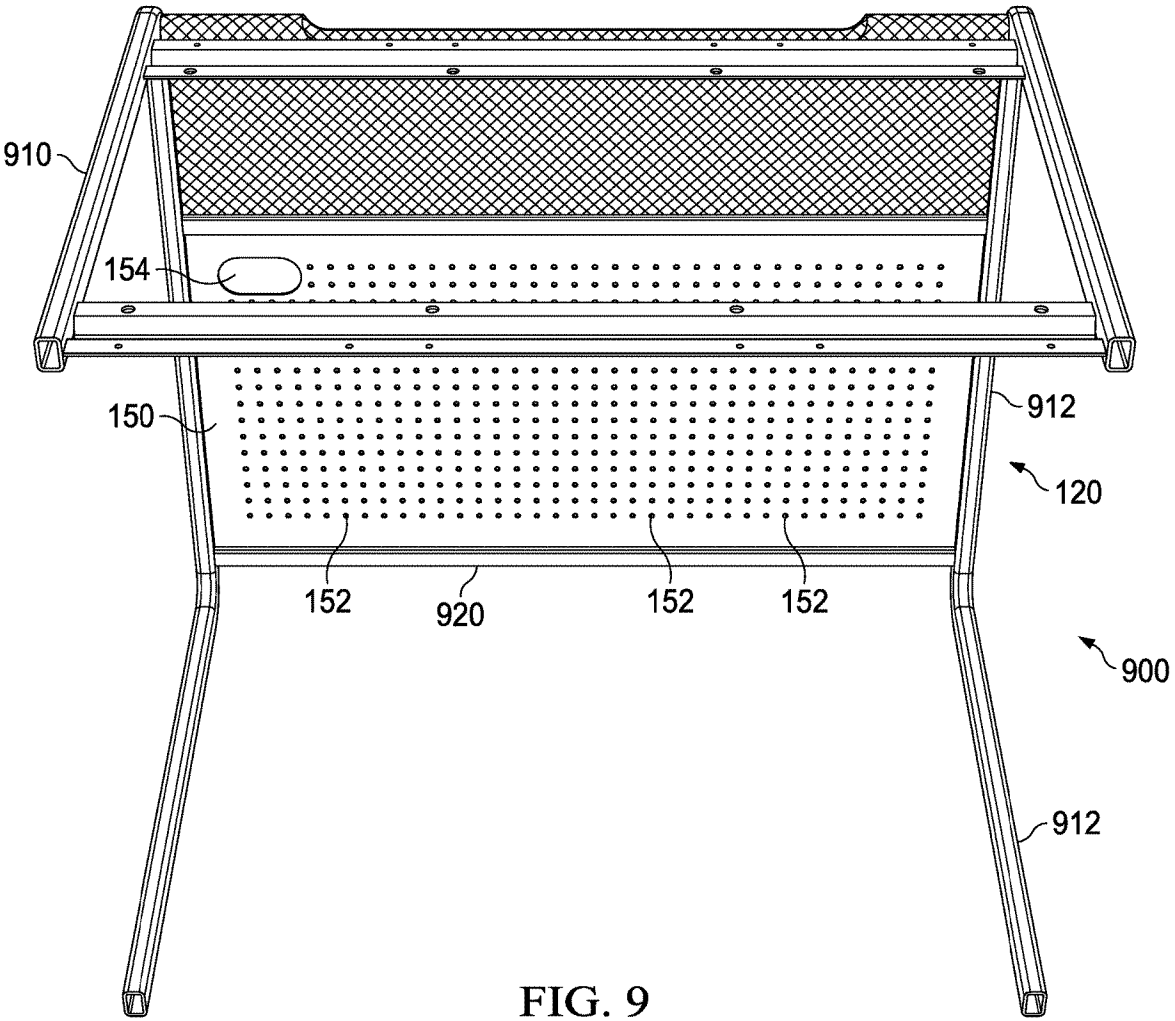
FIG. 9 illustrates an implementation of an example portion of furniture with legs with C-shaped members.

In some implementations, the furniture may include one or more legs with a C-shaped spine member. FIG. 9 illustrates an implementation of an example portion of furniture with legs with C-shaped members. The C-shaped spine member of a leg 130 may include a first section 910, a second section 911, and a third section 912, as illustrated in FIG. 9. The third section of the C-shaped spine member of the leg may be vertically disposed between the first section and the second section. The third section may couple the first section and the second section. As illustrated, the organizational member 150 may include coupling members 152 (e.g., openings, pegs, etc.) and/or apertures (e.g., to allow a user to grip and/or hold the furniture and/or move the furniture; to secure the furniture to for example, walls, floors, etc.; and/or other appropriate purposes). The organizational member 150 may be disposed between and/or coupled to the C-shaped spine member or portions thereof (e.g., third sections and/or first sections). The organizational member 150 may be coupled to other portions of the frame such as kickstand(s). In some implementations, the frame may include a kickstand 920. The first section 910 of the leg may be coupled to other components of the furniture, such as but not limited to, a table top, a vertical board, an easel, etc. The furniture with leg(s) with C-shaped spine members may include one or more of the features of the modular desk system described in U.S. Pat. No. 9,226,579, which is hereby incorporated by reference, such as linkability to other desks, platforms, dividers, hooks, etc.

Although in various implementations, a desk has been described as an example implementation of furniture, other types of tables may include one or more of similar features. Although in various implementations, a freestanding board has been described as an example implementation of furniture, other types of furniture may include one or more similar features.

Descriptions of orientation are relative to the furniture and have been provided to illustrate an example, and not limiting.

U.S. Patents and/or U.S. Patent Applications described as incorporated by reference as herein fully incorporated by reference as to all of the features described in the U.S. Patents and/or U.S. Patent Applications to the extent that the teachings do not conflict with the teachings of the current application. Features in these U.S. Patents and/or U.S. Patent Applications not discussed specifically in the current application are not disclaimed merely absence of a reference to the particular feature in the current application.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "an organizational member" includes a combination of two or more organizational members and reference to "an organizational tool" includes different types and/or combinations of organizational tools.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A table comprising:

one or more organizational members, wherein each organizational member comprises:

a surface; and a plurality of organizational coupling members disposed through the surface, wherein organizational coupling members are adapted to couple with one or more organizational tools;

a frame, wherein the frame comprises:

a first side;

an opposing second side, wherein the table is adapted such that the second side of the frame is disposed on a surface of a location on which the table is disposed;

at least two sets of legs, wherein each set of legs comprises:

a first leg, wherein the first leg comprises a first straight section and a first slanted section; and a second leg, wherein the second leg comprises a second straight section and a second slanted section; and wherein the second slanted section of the second leg and the first slanted section of the first leg are angled towards each other such that the frame is narrower proximate the first side than the second side;

and wherein at least one of the organizational members is disposed in an area disposed between the first and the second legs of at least one of the set of legs; and a table top disposed proximate the first side of the frame, wherein the table top extends beyond the frame, and wherein the table top comprises a top surface and a bottom surface, and wherein the bottom surface is coupled to the frame;

a first seating area disposed between the first legs of two of the sets of legs; and a second opposing seating area disposed between the second legs of two of the sets of legs;

and wherein the tabletop extends at least partially over the first seating area and the second opposing seating area.

2. The table of claim 1 wherein the table top is disposed proximate the first surface of the frame.

3. The table of claim 1 wherein the table comprises a desk.

4. The table of claim 1 wherein one or more of the legs include a caster.

5. The table of claim 1 further comprising one of more shelves disposed between at least two of the set of legs.

6. A freestanding board comprising:

a frame comprising:

a first leg, wherein the first leg comprises a first end and a second opposing end, wherein the second end is closer to a surface on which the freestanding board is disposed than the first end;

a first C-shaped member disposed proximate the second end of the first leg, wherein the first C-shaped member comprises two feet;

a second leg, wherein the second leg comprises a first end and a second opposing end, wherein the second end is closer to the surface on which the freestanding board is disposed than the first end; and a second C-shaped member disposed proximate the second end of the second leg, wherein the second C-shaped member comprises two feet;

an organizational member disposed between the first leg and the second leg of the frame, wherein the organizational member is disposed above the second ends of the first leg and the second leg, and wherein the organizational member comprises a surface; and wherein a plurality of organizational coupling members are disposed on the surface, wherein each of the organizational coupling members are adapted to couple with one or more organizational tools;

a board disposed between the first leg and the second leg of the frame, and wherein the board is above the second ends of the first and second legs.

7. The freestanding board of claim 6 wherein the first leg and the second leg include casters.

8. The freestanding board of claim 6 wherein the board comprises at least one of a writing surface or a screen.

9. The freestanding board of claim 6 further comprising a ledge.

10. The freestanding board of claim 6 wherein one or more of the organizational members comprises openings disposed through the surface of the organizational member.

11. The freestanding board of claim 6 wherein a first end of the board is coupled to the first leg of the frame, and wherein a second opposing end of the board is coupled to a first end of the organizational member, and wherein an opposing second end of the organizational member is coupled to the second leg of the frame.

12. The freestanding board of claim 6 wherein a first end of the board is coupled proximate the first ends of the first and second legs of the frame, and wherein a second opposing end of the board is coupled to a first end of the organizational member, and wherein an opposing second end of the organizational member is coupled proximate the second ends of the first and the second legs of the frame.

13. The freestanding board of claim 6 wherein a first end of the organizational member is coupled proximate the first ends of the first and second legs of the frame, and wherein a second opposing end of the organizational member is coupled to a first end of the board, and wherein an opposing second end of the board member is coupled proximate the second ends of the first and the second legs of the frame.

14. The table of claim 1 wherein one or more of the coupling members of at least one of the organizational members comprises at least one of an opening, a recess, or a protrusion; and wherein the organizational member further comprises one or more apertures.

15. The table of claim 1 further comprising one or more organizational tools.

16. The table of claim 1 wherein one or more of the organizational tools comprises a hook, a loop, a basket, a container, or a bracket.

17. The table of claim 1 further comprising at least one first bracket extending between the first legs of at least two of the sets of legs, and at least one second bracket extending between the second legs of at least two of the sets of legs.

18. The table of claim 17 further comprising at least one of a shelf or a drawer, wherein each shelf is coupled to one of the first brackets and one of the second brackets, and wherein each drawer is coupled to one of the first brackets and one of the second brackets.

19. The table of claim 17 further comprising one or more apertures disposed at least partially through at least one of the organizational members, wherein a user may grip the frame via one or more of the apertures to move the table.

* * * * *